United States Patent [19]

Shaw

[11] Patent Number: 4,938,029

[45] Date of Patent: Jul. 3, 1990

[54] UNLOADING SYSTEM FOR TWO-STAGE COMPRESSORS

[75] Inventor: David N. Shaw, Manlius, N.Y.

[73] Assignee: Carrier Corporation, Syracuse, N.Y.

[21] Appl. No.: 374,907

[22] Filed: Jul. 3, 1989

[51] Int. Cl.[5] ..... F25B 41/04

[52] U.S. Cl. ..... 62/117; 62/196.2; 62/197; 62/228.5

[58] Field of Search ..... 62/196.1, 196.2, 196.3, 62/197, 510, 228.5, 117; 236/1 EA

[56] References Cited

U.S. PATENT DOCUMENTS 2,388,556 11/1945 Lathrop ..... 62/197

3,495,418 2/1970 Kapich ..... 62/228.5 X 3,859,815 1/1975 Kasahara ..... 62/197

4,324,105 4/1982 Cann ..... 62/196.2

4,526,012 7/1985 Chigira ..... 62/196.3

*Primary Examiner*—Harry B. Tanner

*Attorney, Agent, or Firm*—David J. Zobkiw

[57] ABSTRACT

An economizer is connected to a fluid line connecting the first and second stages of a compressor at a point downstream of the bypass for unloading the first stage. The economizer flow controls the discharge temperature of the second stage and, in addition, coacts with the bypassing of the first stage such that all of the flow supplied to the second stage is at system suction pressure when the bypass is fully open.

11 Claims, 2 Drawing Sheets

UNLOADING SYSTEM FOR TWO-STAGE COMPRESSORS

BACKGROUND OF THE INVENTION

The capacity of a two-stage compressor is a function of the volumetric efficiency, $V_e$, the change in enthalpy $\Delta H$, and the displacement efficiency, $D_e$. In two-stage reciprocating compressor systems the cylinders are divided between the two stages with the first stage having, typically, twice as many cylinders as the second stage. Unloading of this arrangement is normally achieved by hot gas bypass or suction cutoff of one or more cylinders of the first stage. In fact, the entire first stage can be unloaded so that the second stage is doing all of the pumping and is being supplied at the compressor suction pressure. Since the entire first stage discharge may be bypassed to suction, this arrangement also serves to negate the capacity increase associated with the use of an economizer.

SUMMARY OF THE INVENTION

Means are employed in a two-stage compression system so as to both control the temperature of the second stage discharge and to unload the compressor. Unloading the compressor is through the use of a bypass which directs the first stage discharge of the compressor back to suction. When the bypass is fully open, the second stage inlet operates at system suction pressure and second stage displacement alone must now handle the vapor generated by both the system evaporator and the economizer. This effectively reduces the vapor generated by the system evaporator to a fraction of its full load amount thus accomplishing very effective unloading.

It is an object of this invention to provide a method and apparatus which provides a simple, efficient and reliable unloading of a two-stage compressor.

It is another object of this invention to provide an economizer operation in a two-stage compressor. These objects, and others as will become apparent hereinafter, are accomplished by the present invention.

Basically, the economizer is connected to the fluid line connecting the first and second stages of the compressor at a point downstream of the bypass line for unloading the first stage. The economizer flow is also directed to control the discharge temperature of the second stage and, in addition, coacts with the bypassing of the first stage such that all of the flow supplied to the second stage is at system suction pressure when the bypass is fully open.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENTS

Figure 1:
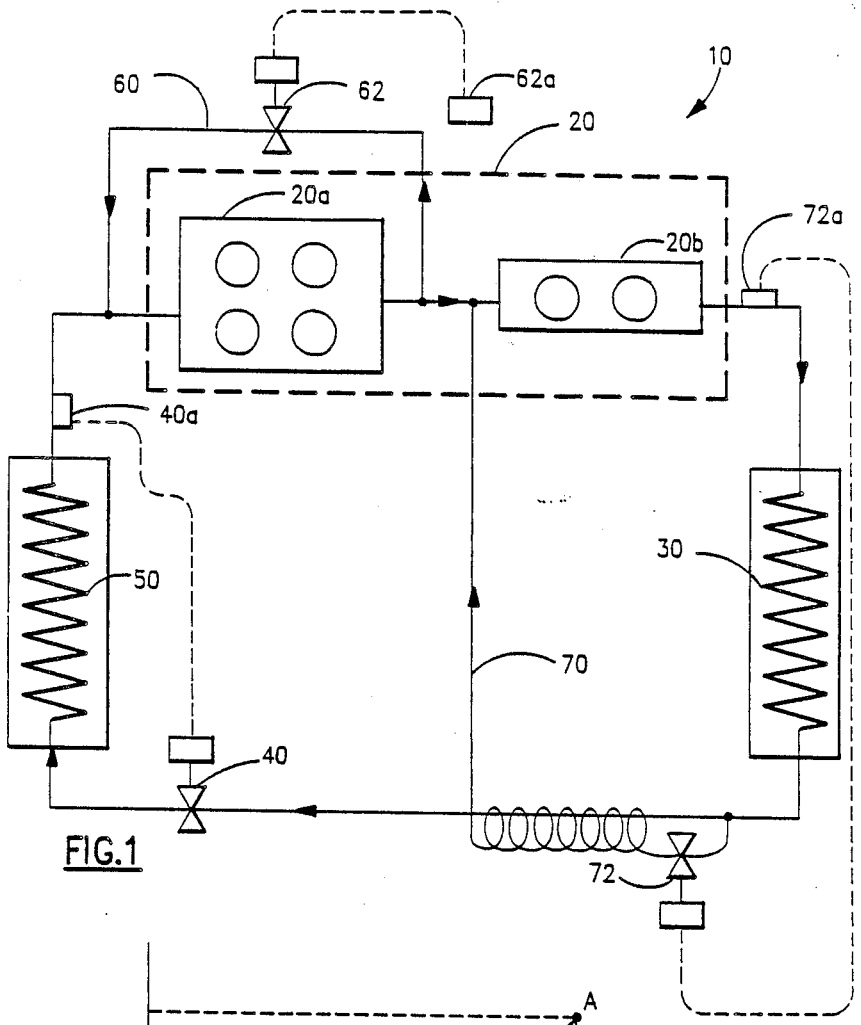
FIG. 1 is a schematic representation of a refrigeration system employing the present invention.

In FIG. 1, the numeral 10 generally designates a refrigeration system employing the present invention.

Refrigeration system 10 includes a reciprocating compressor 20 having a first stage 20*a* and a second stage 20*b* with the first stage 20*a* illustrated as having four cylinders and the second stage 20*b* illustrated as having two cylinders. Compressor 20 is in a circuit serially including first stage 20*a*, second stage 20*b*, condenser 30, thermal expansion valve 40, and evaporator 50. Line 60 contains modulating valve 62 and is connected between the suction and discharge sides of first stage 20*a*. Valve 62 operates in response to the temperature sensed by temperature sensor 62*a* which is in the zone being cooled.

Economizer line 70 extends between a point intermediate condenser 30 and thermal expansion valve 40 and a point intermediate first stage 20*a* and second stage 20*b* but downstream of the intersection with line 60. Valve 72 is located in economizer line 70 and is operated responsive to temperature sensor 72*a* which is located at the outlet of second stage 20*b*. Thermal expansion valve 40 is responsive to temperature sensor 40*a* which is located at the outlet of evaporator 50.

In operation at full load, valve 62 is closed and the entire output of first stage 20*a* is supplied to second stage 20*b*. The hot, high pressure refrigerant gas output of second stage 20*b* is supplied to condenser 30 where the refrigerant gas condenses to a liquid which is supplied to thermal expansion valve 40. Thermal expansion valve 40 is controlled responsive to the outlet temperature of evaporator 50 as sensed by temperature sensor 40*a* and causes a pressure drop and partial flashing of the liquid refrigerant passing through valve 40. The liquid refrigerant supplied to evaporator 50 evaporates and the gaseous refrigerant is supplied to first stage 20*a* to complete the cycle. Valve 72 is operated responsive to the outlet temperature of second stage 20*b* as sensed by temperature sensor 72*a* and controls the flow of liquid refrigerant through line 70 in order to maintain the desired outlet temperature of compressor 20. Liquid refrigerant is expanded down to the interstage pressure in passing through valve 72 and in expanding there is a cooling effect relative to the liquid refrigerant flowing to evaporator 50 with further cooling effect in the second stage 20*b*.

As the load requirements sensed by sensor 62*a* fall, valve 62 is proportionally opened to permit a bypassing of the output of first stage 20*a* back to the suction side. At the extreme, valve 62 will be fully opened thereby completely unloading first stage 20*a* and placing the suction and discharge side of the first stage 20*a* at the same pressure which is also the pressure in evaporator 50. As more of the output of first stage 20*a* is bypassed, the mass flow supplied to the second stage 20*b* decreases. Because second stage 20*b* is always working when compressor 20 is operating, second stage 20*b* is drawing refrigerant into its suction side at all times. Thus, second stage 20*b* always draws at least a portion of the output of the first stage 20*a* which is necessary to maintain flow in evaporator 50 and, in addition, draws whatever flow is permitted by valve 72. As a result, the economizer flow through line 70 is always supplied to the second stage 20*b* rather than being able to bypass the first stage 20*a*. As the first stage 20*a* is unloaded, the interstage pressure and the mass flow to the second stage 20*b* decreases, but the resultant mass flow delivery to the system 10 from the compressor 20 will drop faster than the interstage pressure due to the drop in volumetric efficiency in the second stage.

Figure 2:
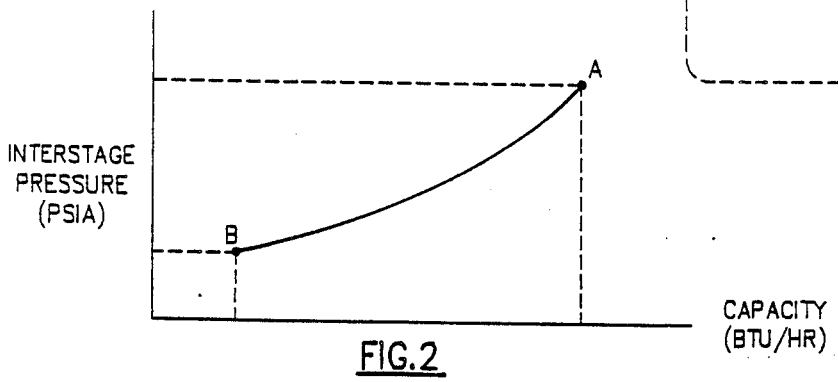
FIG. 2 is a graph showing relationship of capacity to interstage pressure.

Referring now to FIG. 2, the point A represents the conditions for R-22 where valve 62 is closed so that there is no bypassing and the interstage pressure and capacity of system 10 are at their maximums (e.g. 82 psia and 42,000 BTU/hr). Point B represents the fully bypassed condition where valve 62 is fully open and the interstage pressure which is also the suction and evaporator pressure and the capacity of system 10 are at their minimum (e.g. 18 psia and 6,000 BTU/hr). More specifically, point A represents the conditions on a hot day where the volumetric efficiency, $V_e$, is high because at full load the compressor is being utilized as a two-stage compressor and therefore the pressure ratio across each stage is low, the change in enthalpy, $\Delta H$, is high because of the use of an economizer and the economizer flow is directed to the trapped intermediate pressure, and the displacement efficiency, $D_e$, is high because all (four) of the low stage cylinders are actively pumping vapor generated only by the evaporator 50. Point B represents the conditions on a cold day where $V_e$ is low due to the high pressure ratio across the (two) high stage cylinders, $\Delta H$ is higher because the economizer flow is being dumped to a lower pressure, and $D_e$ is very low because only the (two) high stage cylinders are now pumping the evaporator generated flow as well as the economizer generated flow. As a result, the turn down ratio can be about 7 to 1.

Figure 3:
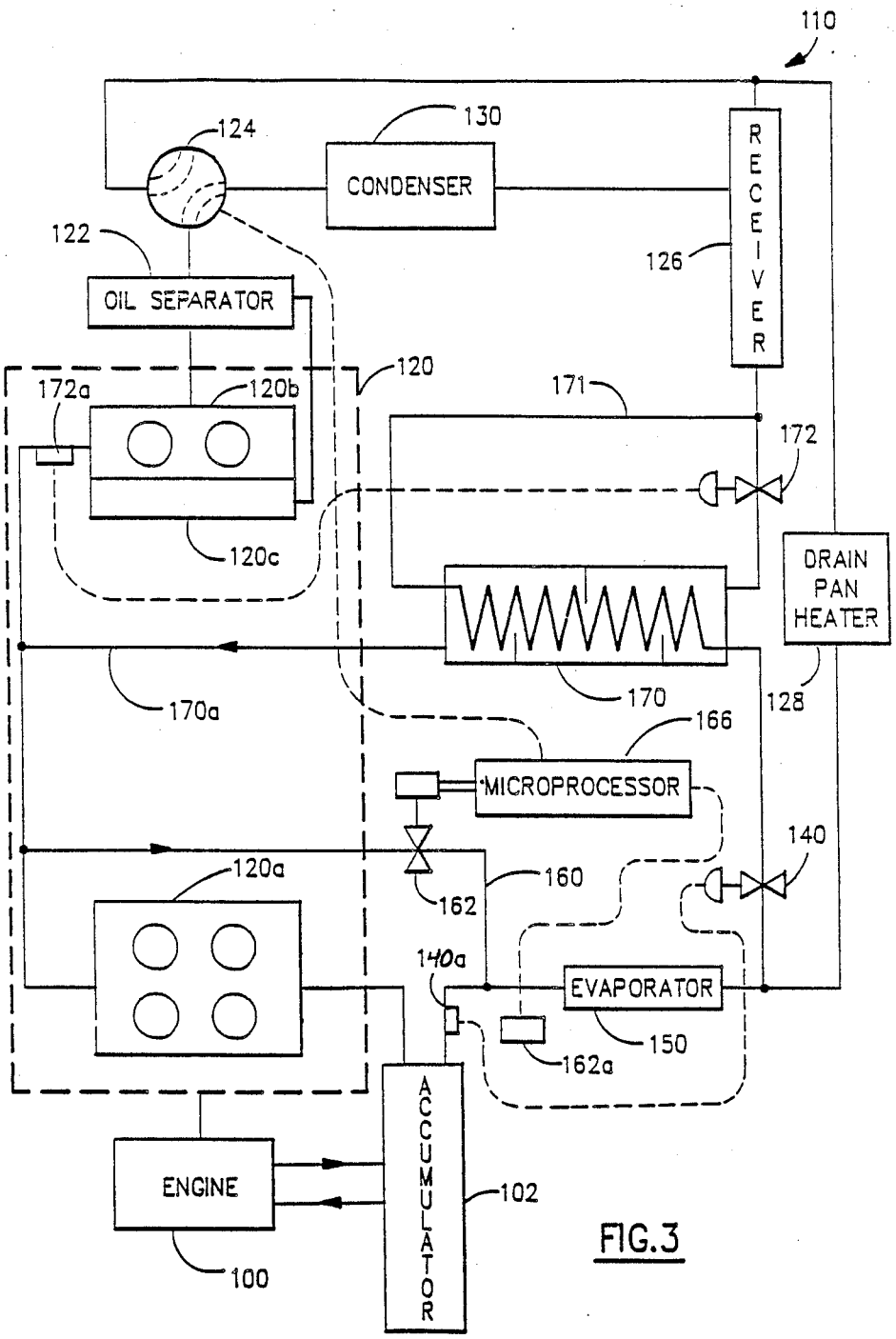
FIG. 3 is a schematic representation of a transport refrigeration system employing the present invention.

Referring now to FIG. 3, which represents the present invention as applied to a transport refrigeration system 110, structure has been labeled one hundred higher than the corresponding structure in FIG. 1. Engine 100 which would typically be an internal combustion engine drives compressor 120 and its cooling system is in heat exchange relationship with accumulator 102. The output of compressor 120 is supplied to oil separator 122 which removes oil which is returned to crankcase 120c. The hot high pressure refrigerant then passes through 3-way solenoid valve 124 which is controlled by microprocessor 166. In the refrigeration mode, the flow is to condenser 130 but in the heating mode and in the defrost mode the flow is to receiver 126 and to drain pan heater 128. In the refrigeration mode the hot high pressure refrigerant supplied to the condenser 130 condenses and is supplied to receiver 126. At full cooling capacity, most of the flow from receiver 126 passes via line 171 to main thermal expansion valve 140 which is controlled via temperature sensor **140*a* which is located at the downstream side of evaporator 150. The liquid refrigerant passing through thermal expansion valve 140 is partially flashed and dropped in pressure before reaching evaporator 150 where the remaining liquid refrigerant evaporates and the gaseous refrigerant is supplied to accumulator 102 and then to first stage 120*a*** to complete the cycle.

At less than full cooling capacity, the first stage **120*a* is fully or partially unloaded by the opening of modulating valve 162 in bypass line 160. Valve 162 is positioned by microprocessor 166 responsive to the cargo container air temperature sensed by sensor 162*a* which is located in the cargo container or space. A suitable valve for use as valve 162** is disclosed in U.S. Pat. No. 3,941,952.

Additionally, economizer/desuperheater flow to the suction side of second stage **120*b* is controlled by temperature sensor 172*a* located at the suction side of second stage 120*b*. When valve 172 is open, a flow path is established through economizer heat exchanger 170 to line 170*a* which is connected between the discharge of first stage 120*a* and the suction of second stage 120*b* but downstream of the connection of line 160. Other than the fact that microprocessor 166 is present and drives valve 162 and the pressure 3-way solenoid valve 124, receiver 126, drain pan heater 128** etc. the operation of the FIG. 3 embodiment will be the same as that of the FIG. 1 embodiment.

Although the present invention has been specifically described in terms of a reciprocating compressor, it is equally applicable to any two-stage compression arrangement. Also, although the economizer flow is supplied downstream of the bypass flow, it could be supplied upstream of the bypass flow if the cooling effects were desired. Further, valves 62 and 162 may be controlled responsive to other conditions or they may be overridden as during startup. Other changes will occur to those skilled in the art. It is therefore intended that the scope of the present invention is to be limited only by the scope of the appended claims.

What is claimed is:

1. An unloading system for a refrigeration system comprising:

a first closed fluid loop serially including a first stage of a compressor means, a second stage of said compressor means, a condenser means, expansion means and evaporator means;

a second fluid loop defining bypass means and fluidly connected to said first loop between a first end located intermediate said first and second stages and a second end located intermediate said evaporator means and said first stage;

first valve means located in said second loop for unloading said first stage back to said second end of said second loop;

a third fluid loop defining an economizer means and fluidly connected to said first loop between a first end located intermediate said condenser means and said expansion means and a second end located intermediate said first and second stages;

second valve means in said third loop for providing an economizer flow;

whereby when said first valve means is fully open said second stage alone must handle refrigerant vapor generated by both said evaporator means and said economizer means thereby unloading said refrigeration system.

2. The unloading system of claim 1 wherein said first end of said second loop is upstream of said second end of said third loop.

3. The unloading system of claim 1 wherein said first valve means is controlled responsive to the temperature in a zone.

4. The unloading system of claim 1 wherein said second valve means is actuated responsive to the temperature of refrigerant discharged from said compressor means.

5. The unloading system of claim 1 wherein said second valve means is actuated responsive to the temperature of refrigerant supplied to said second stage.

6. The unloading system of claim 1 wherein said refrigeration system is a transport refrigeration system and said first valve means is actuated responsive to the temperature in a cargo space.

7. The unloading system of claim 6 wherein said first valve means is controlled by microprocessor means.

8. A method for unloading a refrigeration system including a closed fluid loop serially including a first stage of a compressor means, a second stage of the compressor means, a condenser means, an expansion means and evaporator means comprising the steps of:

operating the compressor means to compress refrigerant gas which is then circulated through the fluid loop;

diverting liquid refrigerant from a point intermediate the condenser means and the expansion means and passing the diverted liquid refrigerant through a valve means to cause flashing and supplying the refrigerant passing through the valve means to the fluid loop at a point intermediate the first and second stages whereby an economizer circuit is established;

diverting the output of the first stage to a point intermediate the evaporator means and the compressor means to unload the first stage whereby when the first stage is fully unloaded the interstage pressure is that of the evaporator means.

9. The method of claim 8 wherein the valve means is operated responsive to the temperature of the refrigerant supplied to the second stage.

10. The method of claim 8 wherein the valve means is operated responsive to the temperature of the refrigerant leaving the second stage.

11. The method of claim 8 wherein the refrigeration system is a transport refrigeration system and the first stage is unloaded responsive to the temperature in a cargo space.

* * * * *